United States Patent [19]

McCabe et al.

[11] 4,209,271

[45] Jun. 24, 1980

[54] STORAGE TANK WITH LIQUID INSULATOR FOR STORING CRYOGENIC FLUIDS USING WATER DISPLACEMENT

[75] Inventors: John S. McCabe, Naperville; Donald C. Stafford, Hinsdale; Royce J. Laverman, South Holland, all of Ill.

[73] Assignee: Chicago Bridge & Iron Company, Oak Brook, Ill.

[21] Appl. No.: 932,444

[22] Filed: Aug. 10, 1978

[51] Int. Cl.[2] ..... E02D 27/38; F17C 3/04

[52] U.S. Cl. ..... 405/210; 62/45; 114/256; 220/217; 405/59

[58] Field of Search ..... 405/53, 59, 210; 62/45; 114/256, 257; 220/18, 216, 217, 228

[56] References Cited

U.S. PATENT DOCUMENTS

| | | | |
|---|---|---|---|
| 3,438,215 | 4/1969 | Frijlink | 62/45 |
| 3,488,969 | 1/1970 | Lacy | 405/210 |
| 3,680,729 | 8/1972 | Bonavent et al. | 220/216 X |
| 3,727,418 | 4/1973 | Glazier | 62/45 |

FOREIGN PATENT DOCUMENTS

| | | | |
|---|---|---|---|
| 2528679 | 1/1977 | Fed. Rep. of Germany | 405/210 |
| 1557806 | 1/1969 | France | 220/217 |

*Primary Examiner*—David H. Corbin

*Attorney, Agent, or Firm*—Merriam, Marshall & Bicknell

[57] ABSTRACT

A liquefied gas storage tank having insulated vertical walls and an insulated top, said tank being located in and surrounded by a body of water with the exterior water level below the top of the tank walls, the tank interior space containing a layer of water in communication with the body of water so that water can be supplied to and be removed from the tank, an insulating layer floating on the water layer in the tank, and a liquefied gas floating on the insulating layer.

The insulating layer can include a float which extends over the water layer except for a rim space between the periphery of the float and the tank walls, and an insulating liquid in the rim space which has a specific gravity less than water and higher than the liquefied gas, and with the insulating liquid being essentially immiscible with water and remaining liquid at the liquefied gas storage temperature.

6 Claims, 12 Drawing Figures

FIG. 3
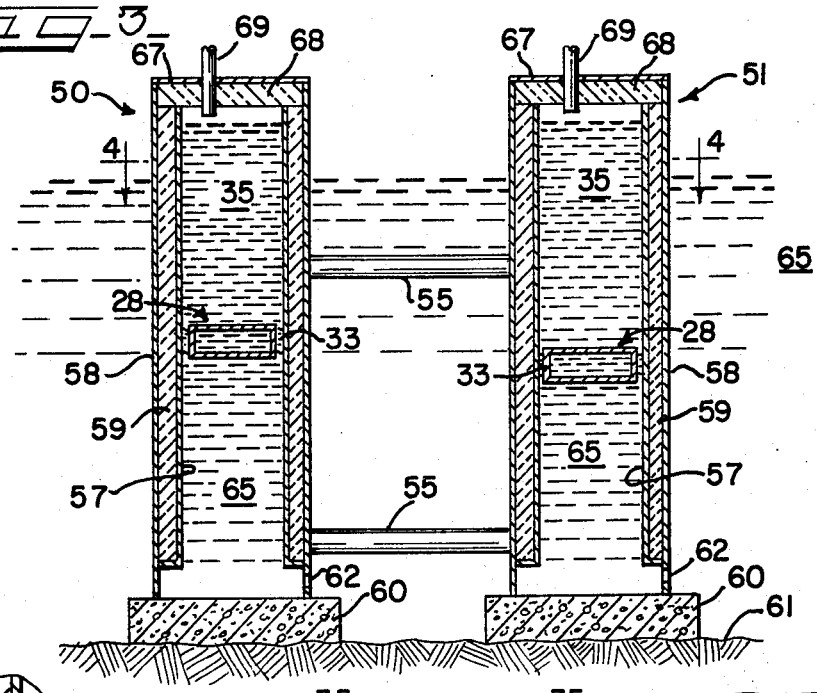
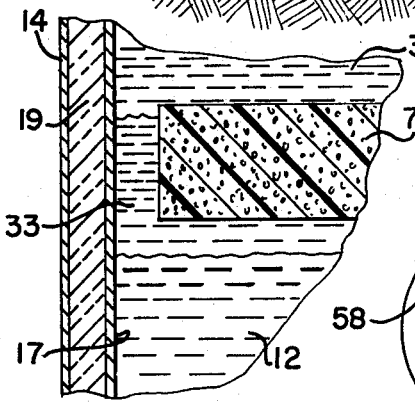
FIG. 12
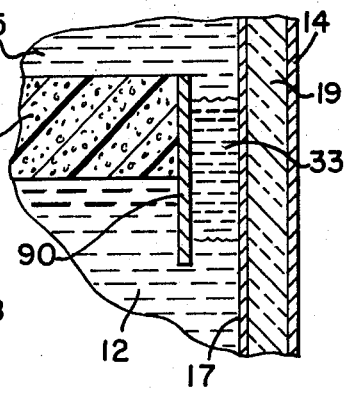
FIG. 11
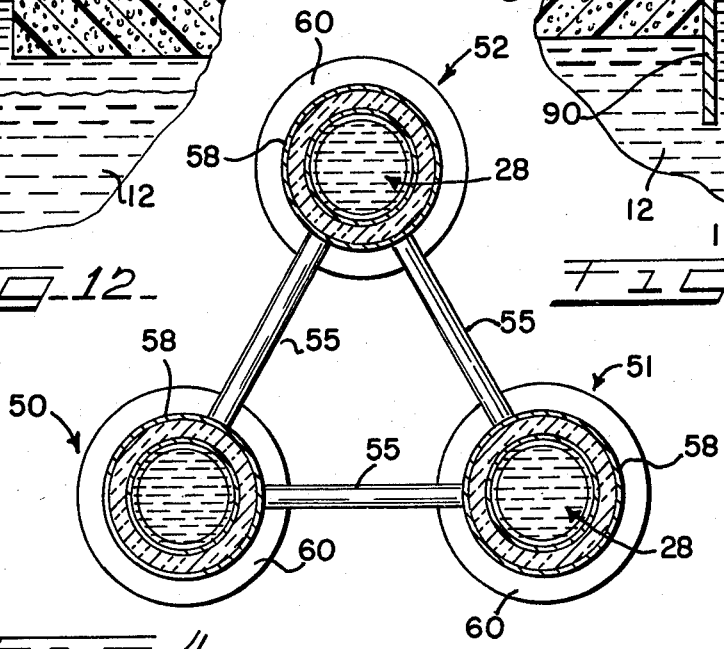
FIG. 4

STORAGE TANK WITH LIQUID INSULATOR FOR STORING CRYOGENIC FLUIDS USING WATER DISPLACEMENT

This invention relates to the storage of liquefied gases onshore and offshore. More particularly, this invention is concerned with novel apparatus and methods for the storage of liquefied gases in a tank onshore or offshore using water displacement.

BACKGROUND OF THE INVENTION

The use of tanks for the storage of liquids has become common. Tanks for the storage of water-immiscible liquids, such as crude oil, offshore operate on the water displacement principle, in accordance with which water is taken into or displaced from the storage tank as the volume of stored oil varies. Such tanks can rest on a seafloor or float in water, and the water can be pumped into and out of the tank as required or the water can be removed from or replaced in the tank by gravity flow with change in stored product volume. Prior art which pertains to this subject are U.S. Pat. Nos. 3,889,477; 3,791,152 and 3,429,128.

The water displacement storage of a liquid such as oil or other hydrocarbon permits location of the tank in water, either in a pit filled with water, or in a lake, ocean or river under conditions which can often provide a natural safety factor. Furthermore, utilization of the water displacement principle for product storage provides inherent tank stability since it is always full or nearly full of a liquid, or two liquids in layers. Also, the liquid contents in the tank counter the external water pressure applied to the tank, thus making it feasible to use a thinner tank shell with less reinforcement than would be required for a tank intended at times to be periodically empty, or partially empty but having the water pressure applied to the shell exterior.

In addition to the storage of materials which are liquids at ambient conditions (i.e. , 25° C. and 760 mm. atm. pressure), it is common to storage gases such as natural gas, propane, oxygen and hydrogen in liquefied form, very often at temperatures low enough to permit storage of the liquefied gases at or slightly above atmospheric pressure to make unnecessary the use of a pressure vessel for storage of the liquefied gas. U.S. Pat. Nos. 3,559,835 and 3,419,174 show the storage of liquefied gases in insulated tanks onshore. Others have recognized the need for offshore storage tanks for liquefied gases, and for such tanks onshore but located in water-containing pits. See, for example, U.S. Pat. Nos. 3,898,846 and 3,828,565.

Another U.S. Pat. No. 3,727,418 discloses subaqueous storage of liquefied gases. A first closed container holds a liquefield gas which is separated from a balancing liquid, such as isopentane, therein by a flexible menbrane. A second container communicates with the balancing liquid in the first container so that when a liquefield gas is fed to the first container the balancing liquid flows to the second container and this is reversed when liquefied gas is removed from the first container. The second container is divided by a flexible membrane with balancing liquid on one side and water on the other side. Water flows in and out of the second container by gravity and provides the pressure which forces balancing liquid into the first container. At no time is water introduced into the first container so that a very large amount of isopentane, equal to the first container storage volume, is needed in this system.

U.S. Pat. No. 3,438,215 shows an insulated storage tank with a floating roof which has liquefied methane above, and isopentane below, the roof. The isopentane is used as a cold-carrier. No water is in the tank.

SUMMARY OF THE INVENTION

According to the present invention there is provided a novel improved system for storing a cryogenic liquid, or liquefied gas, in an insulated tank using the water displacement principle. The invention broadly comprises the combination of a liquefied gas storage tank having insulated vertical walls and an insulated top, said tank being located in and surrounded by a body of water which the exterior water level below the top of the tank walls, the tank interior space containing a layer of water in communication with the body of water so that water can be supplied to and be removed from the tank, an insulating layer floating on the water layer in the tank, and a liquefied gas floating on the insulating layer.

The insulating layer may be solely an insulating liquid which has a specific gravity less than water and higher than the liquefied gas, said insulating liquid being essentially immiscible with water and the liquefied gas. The insulating liquid, of course, must not solidify at the temperature of the liquefied gas or cryogenic liquid in the tank.

Because there is likely to be turbulence in the tank during filling and emptying which could cause an insulating liquid layer by itself to intermix with the water or the liquefied gas, thereby eliminating the required insulating action, it is desirable to include, as part of the insulating layer, a float which extends over the water layer except for a rim space between the periphery of the float and the tank walls, and an insulating liquid in the rim space which has a specific gravity less than water and higher than the liquefied gas, said insulating liquid being essentially immiscible with water, and remaining liquid at the liquefied gas storage temperature. The insulating liquid should preferably be immiscible with the liquefied gas. Alternatively, the insulating liquid could be miscible with the liquefied gas, but have an acceptably low rate of solution at the interface between the two liquid layers. The float can be a closed shell filled with insulating liquid, a shell open at the top or bottom, or it can be an open network filled with insulating liquid. The float, furthermore, can be made partially or wholly of insulating material. Regardless of the particular material used in its construction it is important that the float, whether open or closed, be capable of floating between the water and the liquefied gas.

The invention is particularly suitable for the storage of liquefied natural gas, or a syntetic counterpart corresponding thereto, at about atmospheric pressure or slightly thereabove. Natural gas at about atmospheric pressure is a liquid at −260° F.

A particularly useful insulating liquid, particularly for liquefied natural gas storage, is a pentane or mixture of pentanes. Isopentane is especially preferred.

BRIEF DESCRIPTION OF THE DRAWINGS

FIG. 3 is a vertical section view through two of three storage tanks, joined together by braces, resting on a seafloor;

FIG. 4 is a sectional view taken along the line 4—4 of FIG. 3;

FIG. 11 is a vertical sectional view like FIG. 7 but with a downwardly depending skirt on the edge of the float; and FIG. 12 is a vertical sectional view like FIG. 7 but with insulating liquid below the float as well as in the rim space.

DETAILED DESCRIPTION OF THE DRAWINGS

So far as is practical, the same or similar elements or parts which appear in the various views of the drawings will be identified by the same numbers.

Figure 1:
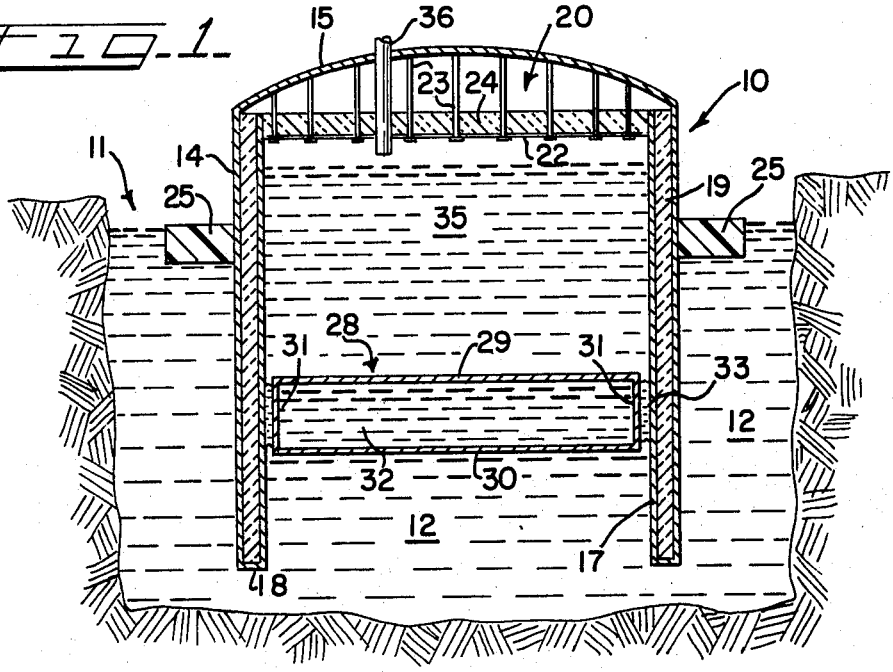
FIG. 1 is a vertical sectional view through a floating liquefied gas storage tank in a water-containing pit.

With reference to FIG. 1, the liquefied gas storage tank 10 is shown floating in a pit 11 filled with water 12. Tank 10 has an outer vertical circular cylindrical metal shell or wall 14 which supports domed outer roof 15. Inner vertical circular cylindrical metal shell or wall 17 is joined at the bottom to the bottom of outer shell 14 by plate 18. Insulation 19 is placed between outer shell 14 and inner shell 17. A suspended ceiling 20 closes the top of inner shell 17. The suspended ceiling 20 has a horizontal metal deck 22 suspended by rods 23 from the inside of domed outer roof 15. Insulation 24 is placed on top of deck 22. Buoyancy chamber ring 25 is mounted on the upper part of outer shell 14 and is made large enough to keep the tank 10 floating in the water.

Figure 5:
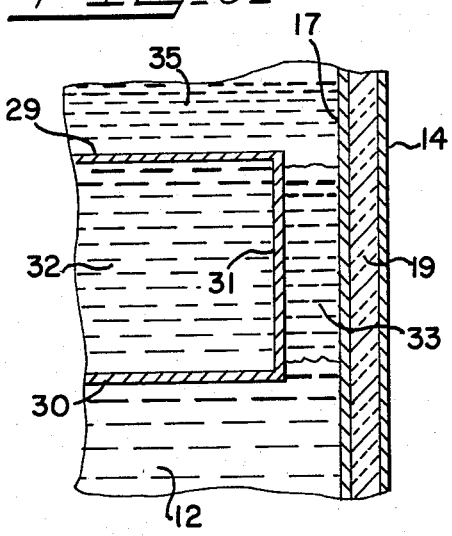
FIG. 5 is a vertical sectional view of the side edge of a float in the form of a shell filled with an insulating liquid.

Inside of tank 10 is positioned a float 28 in the form of a shell having a flat metal top 29, a flat metal bottom 30, and a vertical cylindrical side edge or wall 31 spaced inwardly from inner shell 17. An insulating liquid 33, such as a pentane or mixture of pentanes, is placed in the rim space between float side wall 31 and inner shell 17 as is shown in FIG. 1 and even more clearly in FIG. 5. The insulating liquid may also extend underneath the float, as shown in FIG. 12, depending on the amount of total insulation required and the design of the float. The insulating liquid must be a liquid which is immiscible with water.

Conduit 36 penetrates the tank and can be used to remove vapor released from the liquefied gas 35. Suitable conduits, not shown, would be provided for filling the tank above float 28 with a liquefied gas and removing it from the tank. As the tank is filled with liquefied gas the float 28 descends in the tank, with insulating liquid 33 in the rim space, and with displacement of water from the tank interior beneath float 28. The float 28 is designed to have a density between that of the liquefied gas 35 and the insulating liquid so that it always stays between these two liquids. Similarly, the insulating liquid 33 has a specific gravity between that of the float 28 and water so that it always stays between the float and the water regardless of the amount of liquefied gas or water in the tank.

Figure 2:
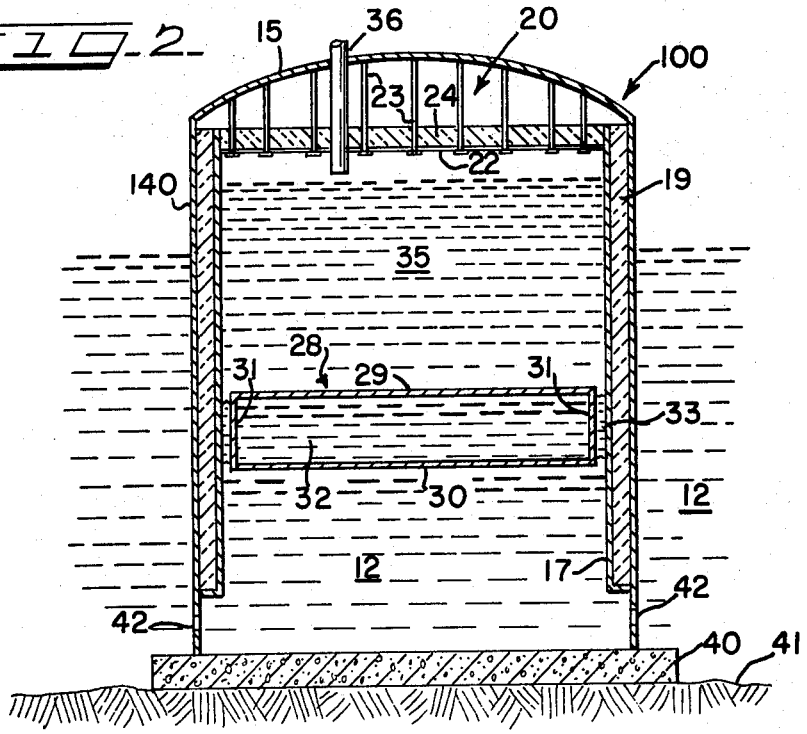
FIG. 2 is a vertical sectional view through a liquefied gas storage tank supported on a sea floor.

The embodiment shown in FIG. 2 is similar to the embodiment shown in FIG. 1 so only the differences will be described. As shown in FIG. 2, the tank 100 has an outer shell 140 which extends at the bottom into supporting contact with base 40 which rests on seafloor 41. Holes 42 are provided in the lowermost part of outer shell 140 so that sea water can flow in and out of the tank when it is emptied and filled with a liquefied gas. Since the tank 100 is supported by seafloor 41, no buoyancy chamber 25 such as shown in FIG. 1 need be provided. The operation of the embodiment illustrated by FIG. 2 is the same as that of FIG. 1.

FIGS. 3 and 4 show an additional embodiment of the invention in which three identical liquefied gas storage tanks 50, 51 and 52 are joined together by braces 55. Each tank has an inner metal cylindrical shell 57, circular in horizontal section, and an outer metal cylindrical shell 58 with insulation 59 between the shells. The outer shell 58 is supported on base 60 which rests on seafloor 61. At least one hole 62 is located in the lower part of outer shell 58 so that seawater 65 can flow in and out of the tank. Roof 67 is supported by outer shell 58 and insulation 68 is positioned beneath the roof. Conduit 69 is provided for vapor to be removed when it forms in the tank. Suitable conduits, not shown, will of course be included to feed a liquefied gas to each of tanks 50, 51 and 52 separately and to remove it therefrom at appropriate times and each tank is to be separately operable. Each tank has a float 28 therein as previously described with respect to FIG. 1. The operation of each tank 50, 51 and 52 is as already described with respect to FIGS. 1 and 2.

Figure 6:
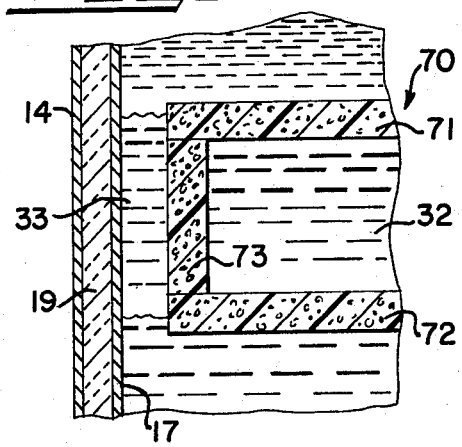
FIG. 6 is a vertical sectional view of the side edge of a float having an insulated shell filled with an insulating liquid.

FIG. 6 shows a second embodiment of float. In this embodiment the float 70 has a top 71, bottom 72 and vertical side edge or wall 73 of insulating material.

Figure 7:
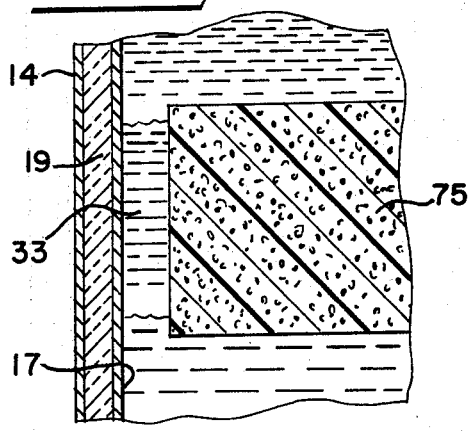
FIG. 7 is a vertical sectional view of the side edge of a solid float made of insulating material.

In the embodiment shown in FIG. 7, the float 75 is solid insulating material such as polyurethane foam having a heavier material embedded therein to provide a float with an average density between those of the insulating liquid and water.

Figure 8:
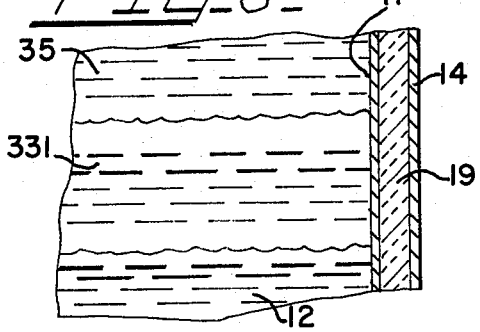
FIG. 8 is a vertical sectional view through a storage tank side wall portion showing a layer of insulating liquid between water beneath it and liquefied gas above it and with no float used.

FIG. 8 illustrates the invention using only a layer of insulating liquid 331 between the liquefied gas 35 and water 12. This embodiment requires, for successful implementation, that there not be undue turbulence in the tank when it is filled with and emptied of a liquefied gas. If there is too much turbulence, the insulating liquid could be displaced as a barrier between the liquefied gas and the water and this would result in the water freezing.

Figure 9:
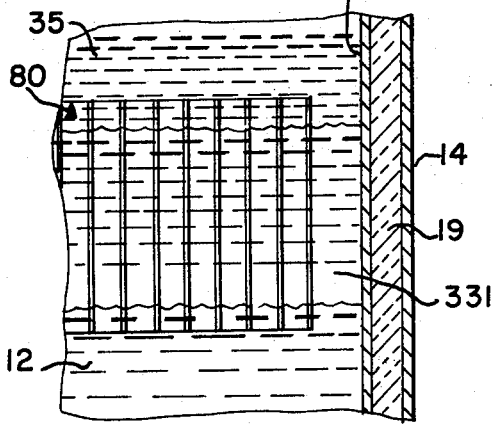
FIG. 9 is a vertical sectional view of the side edge of a honeycomb float open at the top and bottom.

FIG. 9 shows a honeycomb float 80 in which the cells are open at the top and bottom. A layer of insulating liquid 331, located between the water 12 and liquefied gas 3, fills most of the honeycomb float 80. The cells of the float function as stilling chambers, reduced the posibility of the insulating liquid 331 being displaced out from between the water and liquefied gas and reduce the convection heat and mass transfer rate in the insulating liquid.

Figure 10:
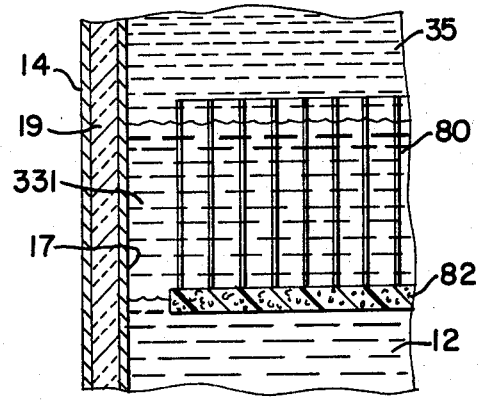
FIG. 10 is a vertical sectional view like FIG. 9 but with a layer of insulation forming a bottom on the honeycomb float.

The embodiment shown in FIG. 10 is similar to that shown in FIG. 9. The embodiment of FIG. 10, however, has an insulating layer 82 connected to the bottom of honeycomb float 80 to further retard heat flow and prevent displacement of the insulating liquid out of the cells. Even if the insulating liquid is displaced from the cells temporarily, the insulating layer 82 can prevent the water from freezing. The insulating layer 82 could also be placed at the top of honeycomb float 80.

FIG. 11 is like FIG. 7 but shows a skirt 90 on the edge of float 75 for increasing the depth of insulating liquid 33 in the rim space.

FIG. 12 is also like FIG. 7, but shows insulating liquid 33 in the rim space and beneath the float 75.

In a specific illustration of the invention with reference to FIG. 1, the liquefied gas can be liquefied natrual gas at −260° F. and 15 psia having a density of 26 pounds per cubic foot. An insulation or liquid filled float can be used having a density of 38–49 pounds per cubic foot and isopentane can be used at the float rim space. Water, of course, weighs 62.4 pounds per cubic foot at 60° F. The rim space will be about 3 feet high and filled with pentane, isopentane or a mixture thereof.

This detailed description has been given for clearness of understanding only, and no unnecessary limitations should be understood therefrom, as modifications will be obvious to those skilled in the art.

What is claimed is:

1. In combination:

a liquefied gas storage tank having insulated vertical walls and an insulated top, said tank being located in and surrounded by a body of water with the exterior water level below the top of the tank walls, the tank interior space containing a layer of water, which extends completely across the tank inner width, in communication with the body of water so that water can be supplied to and be removed from the tank, an insulating float floating on the water layer in the tank, said float being a shell having a top, bottom and vertical cylindrical side wall spaced inwardly from the inner surface of the tank wall to provide a rim space, and said float extending over the water layer except at the rim space, an insulating liquid in the rim space which has a specific gravity less than water and higher than a liquefied gas floating on the insulating layer, and said insulating liquid being essentially immiscible with water, in direct contact with the liquefied gas and the water along the entire rim space, and remaining liquid at the liquefied gas storage temperature.

2. A combination according to claim 1 in which the float is a shell filled with insulating liquid.

3. A combination according to claim 1 in which the insulating liquid is a pentane or mixture of pentanes.

4. A combination according to claim 1 in which the liquefied gas is liquefied natural gas.

5. A combination according to claim 1 in which the insulating liquid extends beneath the float.

6. A combination according to claim 1 in which a skirt is attached to the float to extend the depth of insulating liquid in the space between the float and tank wall.

* * * * *